United States Patent [19]

Martinez

[11] Patent Number: 4,700,834

[45] Date of Patent: Oct. 20, 1987

[54] PRODUCT FOR PREVENTING YARN TAIL BREAKAGE DURING YARN WINDING

[75] Inventor: Antonio Martinez, Gastonia, N.C.

[73] Assignee: Conitex, Inc., Gastonia, N.C.

[21] Appl. No.: 798,599

[22] Filed: Nov. 15, 1985

[51] Int. Cl.[4] ..... B65D 85/00

[52] U.S. Cl. ..... 206/388; 242/18 DD; 242/118.32

[58] Field of Search ..... 206/388, 389, 392, 393, 206/394; 242/18 DD, 118.3, 118.32, 125.1

[56] References Cited

U.S. PATENT DOCUMENTS

| | | | |
|---|---|---|---|
| 2,273,373 | 2/1942 | Perry | 242/118.32 |
| 2,327,738 | 8/1943 | Perry | 242/118.32 |
| 2,451,468 | 10/1948 | Boyce | 206/389 |
| 3,263,942 | 8/1966 | Elwell | 242/118.32 |
| 3,361,381 | 1/1968 | Livingstone | 242/18 DD |
| 3,830,439 | 8/1974 | Porter | 242/18 DD |
| 3,831,869 | 8/1974 | Sartori | 242/18 DD |
| 3,921,922 | 11/1975 | Wust | 242/18 DD |
| 3,958,776 | 5/1976 | Campener et al. | 242/118.32 |
| 4,299,357 | 11/1981 | Munker | 242/18 DD |
| 4,591,105 | 5/1986 | Niederer | 242/18 DD |

FOREIGN PATENT DOCUMENTS

| | | | |
|---|---|---|---|
| 888860 | 2/1962 | United Kingdom | 206/389 |

*Primary Examiner*—Stephen Marcus
*Assistant Examiner*—David T. Fidei
*Attorney, Agent, or Firm*—W. Thad Adams, III

[57] ABSTRACT

A tubular yarn package (10) is disclosed of the type held by at least one end on a rotatably mounted plate. The plate fits into one end of package (10) and traps across the end against an inner wall of the package a length of yarn. Short length of spirally extending grooves (15) are formed in the inner wall of the package (10) adjacent to the end of the package. The yarn fits into the closest adjacent groove (15) and grips the yarn sufficiently to prevent breakage of the yarn by relative movement between the package (10) and the plate occasioned by starting or stopping the rotation of the package (10).

9 Claims, 14 Drawing Figures

10
30
31
40
41
42
43
44
50
51
52
53
54
55
58

PRODUCT FOR PREVENTING YARN TAIL BREAKAGE DURING YARN WINDING

TECHNICAL FIELD AND BACKGROUND OF THE INVENTION

This invention relates to a method and product for preventing yarn tail breakage during yarn winding. The invention disclosed in this application has particular utility in the winding of cones with yarn intended for knitting. These cones are wound with "tails" which permit the trailing end of yarn on an exhausted cone to be tied to the leading end of yarn on the succeeding full package. The tail is necessary if the transfer from the exhausted to the full package is to take place without dropping needles, which causes a serious defect in the knitted fabric.

While the invention disclosed in this application has utility on a number of different types of cones, for purposes of illustration the invention will be described with reference to a tubular textile yarn package which is formed of pressed paper and has a generally frusto-conical shape. While cones come in various configurations, one common type of cone is a cone which has an angle of taper of 5 degrees, 57 minutes.

As described above, this type of cone must be wound with a tail in order for it to be considered a first quality package. The tail is usually formed by taking a length of yarn and extending part of it over the open mouth of the large end of the cone. The cone is then applied to a cradle which has a cone holder base plate which fits into the large end of the cone and holds the yarn, and a cone holder nose plate which secures the cone for proper rotation about a fixed axis. The cone is wound by surface drive against a rotating drum which feeds the yarn onto the rotating cone in a predetermined pattern.

Until relatively recently, winders were designed so that the cone holder base plate had an internal taper which corresponded to the taper of the cone. This meant that for a fairly substantial distance on the order of $\frac{1}{4}$ of an inch, the surface of the cone holder base plate and the inner surface of the cone were parellel with each other and in flush contact. The yarn trapped across the mouth of the cone was thereby held firmly along the entire length of contact between the cone and the base plate. This resulted in a secure grip while, at the same time, spread any stress applied to the yarn over a relatively long distance.

However, when it became necessary to change the type of cones being wound, it was necessary to change the cone holder base plate and nose plate to accommodate the new size and/or taper of the new cone. This required substantial labor, expense and, in addition, reduced the maximum possible operating time of the winder with a corresponding loss of operating efficiency.

Therefore, some winder manufacturers have designed cradles which have universal cone holder base plates and nose plates. The plates are adapted to receive cones having various angles of taper without the additional labor and lost operating time required to conform the cradle to the precise type of cone being wound. While substantial efficiencies are achieved by this new type of winder, the angle of the portion of the base plate which fits into the large end of the cone is no longer necessarily parallel to and flush with the inner surface of the cone. Therefore, the yarn tail passes between the cone and the base plate at two diametrically opposed edges rather than wide, flush surfaces. As long as there is little or no relative movement between the base plate and cone, this fact is of little consequence. Therefore, when starting an empty cone, there is little difficulty since the cone itself is very lightweight and has very little inertia. Accordingly, the cone begins rotation with the base plate and there is no relative movement which could cause the yarn to be pinched or cut. However, as yarn is wound onto the cone, it increases substantially in weight and inertia.

Many winders have automatic stop motions which utilize, for example, an air brake to very quickly stop the rotation of cone when the package is full or when a break in the yarn occurs. The substantial inertia created by a full or near full package is sufficient to cause the package to rotate relative to the base plate during stopping and staring. In the new types of winders described above, the edge of the base plate which presses against the yarn exerts a substantial amount of force and is more than sufficient to cut the yarn in two. As a result, the yarn package is no longer first quality and must either be rewound or sold as second quality. The invention described in this application solves this problem easily, efficiently and inexpensively.

SUMMARY OF THE INVENTION

Therefore, it is an object of the invention to provide a textile cone which prevents breakage of the yarn tail during winding.

It is another object of the invention to provide a tubular textile yarn package which is particularly adapted for use on winders of the type having cradles adapted for winding various shapes and sizes of cones without adjustment or modification.

It is another object of the present invention to provide a method of preventing breakage of yarn tails on tubular textile packages occasioned by relative movement between a textile package and a plate on which it is mounted for rotation.

These and other objects of the present invention are achieved in the preferred embodiment disclosed below by providing in a tubular textile yarn package the improvement which comprises yarn protection means associated with and proximate to one end of the package for gripping the yarn at at least one point in the area of contact between the package and a base plate on which the package rotates in order to prevent breakage of the yarn by relative movement between the package and the plate occasioned by starting or stopping rotation of the package, especially when the package is full or near full.

According to a preferred embodiment of the invention, the yarn protection means comprise a plurality of closely spaced-apart grooves formed in the inner wall of the package adjacent to the end of the package and adapted to receive a length of yarn therein.

According to the same preferred embodiment of the invention, the grooves extend completely around the inner wall of the package and are formed by knurling.

Preferably, the grooves are formed in the textile package in a criss-cross configuration and comprise a multiplicity of closely spaced-apart serrations.

According to another embodiment of the invention, the yarn protection means comprises a ring of loose, non-woven fibrous material positioned on the inner wall of the package and having a thickness sufficient to receive and cushion the yarn against pinching and breakage caused by relative movement between the plate and the package.

According to the preferred method of the invention, breakage of yarn tails on tubular textile yarn packages is prevented by associating with the package proximate one end of the package, yarn protection means for gripping the yarn at at least one point thereon in the area of contact between the package and plate.

According to a preferred embodiment of the method, a plurality of closely spaced-apart grooves is formed in the wall of the package adjacent one end.

In another embodiment of the method, a ring of loose, non-woven fibrous material is positioned on the inner wall of the package and has a thickness sufficient to receive and cushion the yarn against pinching and breakage caused by relative movement between the plate and the package.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
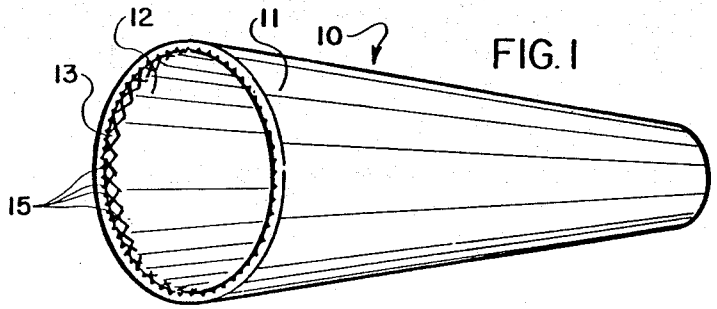
FIG. 1 is a perspective view of a tubular textile yarn package having yarn protection grooves therein.

Referring now specifically to the drawings, a tubular textile yarn package of the type which will be referred to hereinafter as a cone is shown in Figure 1 and generally designated at reference numeral 10. Cone 10 is constructed of pressed paper and comprises an outer conical wall 11 and an inner, conical wall 12, which collectively define a large end 13 and an opposed small end 14. In accordance with one embodiment of the invention, a plurality of criss-crossed helical grooves 15 are cut into the inner wall 12 of cone 10 proximate the large end 13. Each of the grooves is approximately 0.3 cm. long, but an exact length is not essential. Each of the grooves 15 preferably communicates with the end edge of package 10. This is most clearly shown in FIG. 2.

Figure 3:
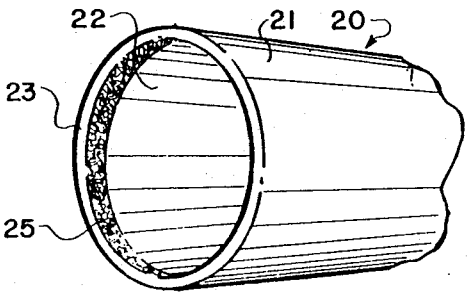
FIG. 3 is a fragmentary perspective view of a tubular textile yarn package according to another embodiment of the invention and including for yarn protection a ring of loose, non-woven fibrous material.

Another embodiment of the invention is shown in FIG. 3. A cone indicated at broad reference numeral 20 has an outer wall 21 and inner wall 22, a large end 23 and a small end (not shown) and is provided with a ring of loose, non-woven fibrous material 25 which is positioned on inner wall 22 proximate the large end 23. The ring of fibrous material 25 may be integrally formed in cone 20 by abraiding the paper from which cone 20 is constructed at the desired position until the fibers become loose and assume a bulked configuration.

Figure 4:
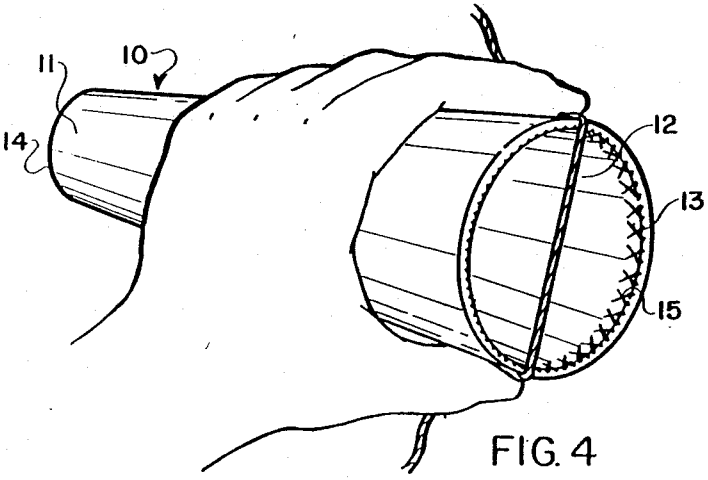
FIG. 4 is a perspective view of a tubular textile yarn package showing the manner in which the yarn tail is formed by positioning the yarn over the mouth of the package before inserting the package in the winder cradle.

Referring now to FIG. 4, the manner in which a yarn tail is prepared is shown. The package 10 is held in the hand and an end of yarn is positioned over the large end 13. In this position, cone 10 is ready to be placed in the winder cradle.

Figures 5, 13, 14:
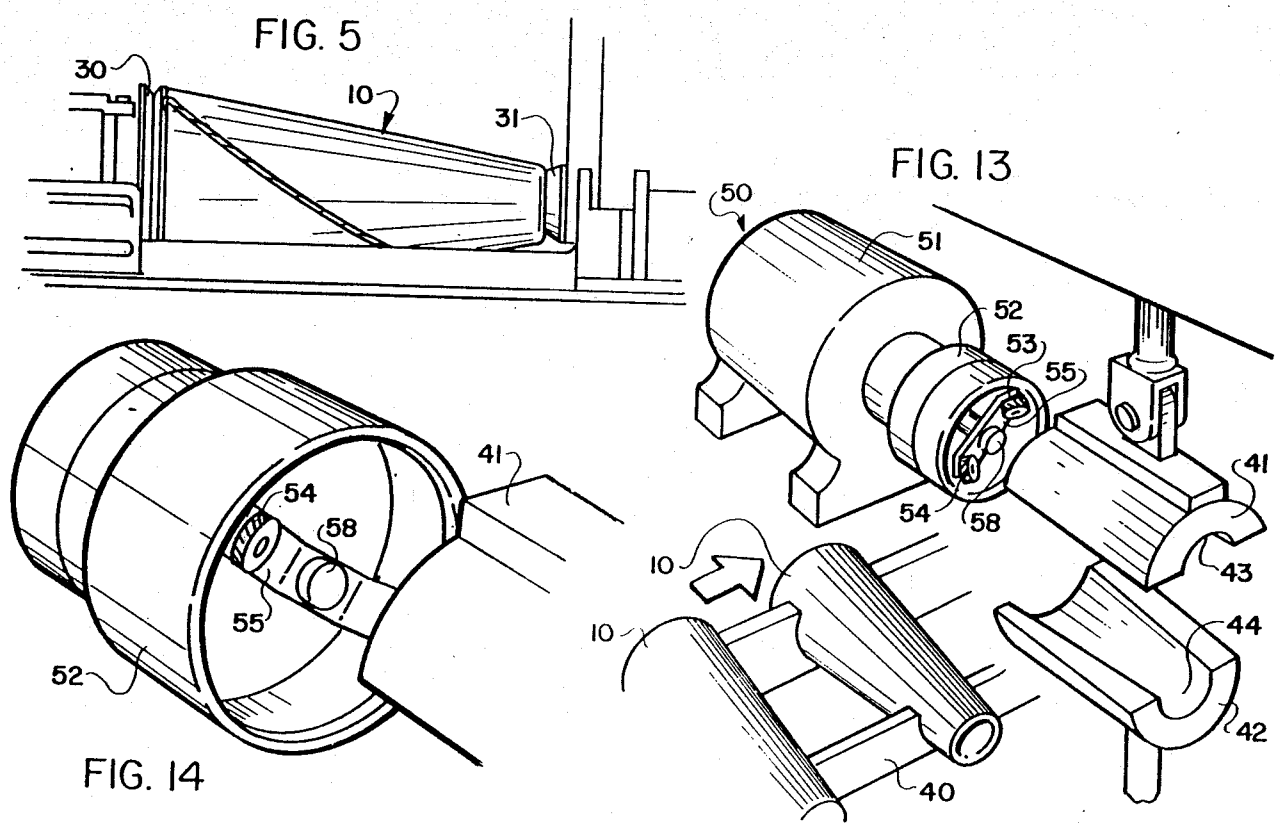
FIG. 5 is a fragmentary view of a yarn package in position on a winder cradle.
FIG. 13 is a perspective view of the machine which knurls the criss-crossed grooves into the large end of the textile package in accordance with the invention.
FIG. 14 is a fragmentary enlarged view of the knurling portion of the machine shown in FIG. 13.

FIG. 5 illustrates, in fragmentary form, the position of package 10 on a conventional winder cradle. The winder cradle includes a cone holder nose plate 30 which fits into the large end 13 of cone 10. A cone holder nose plate 31 fits into the small end 14 of cone 10 and holds cone 10 for rotation. Cone 10 rotates against a driving drum (not shown) which has grooves therein which guide the yarn in a predetermined pattern onto cone 10.

Figure 6:
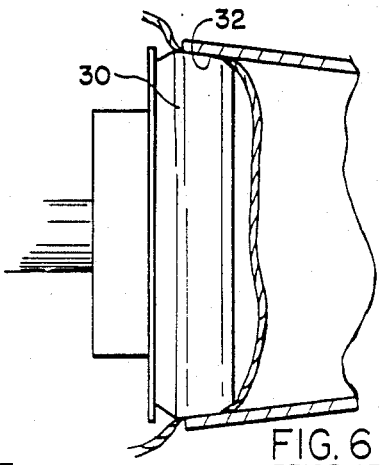
FIG. 6 PRIOR ART
FIG. 6 is a fragmentary cross-sectional view of a prior art textile package on a winder of the type wherein the angle of the base plate taper corresponds to the angle of taper of the textile package.

Referring now to FIG. 6, it can be seen that, according to the construction of prior art winders, the cone holder base plate 30 is provided with a tapered plate surface 32 which corresponds more or less exactly with the taper of the wall 12 of cone 10. Therefore, as can be seen, the yarn is trapped between the inner wall 12 of cone 10 and the base plate surface 32 over a substantial distance, thereby securing the yarn against relative movement between cone 10 and base plate 30. As is apparent, the flush surfaces avoided pinching as a result of a sharp edge being pressed against the yarn.

Figure 7:
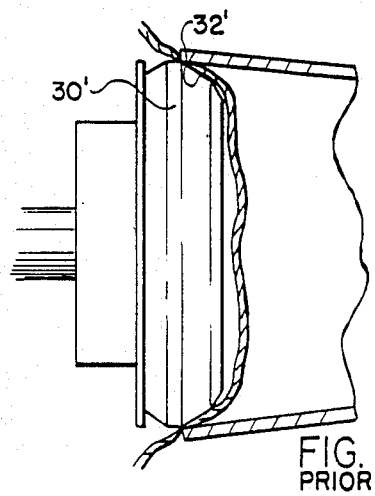
FIG. 7 PRIOR ART
FIG. 7 is a fragmentary cross-sectional view of a prior art textile package in position on a winder base plate of the type adapted to fit several sizes and tapers of cones.

FIG. 7 shows the next development in the prior art, whereby a cone holder base plate 30' is provided with a tapered surface 32' which does not necessarily lie flush with the inner surface of the cone. Accordingly, the yarn is not held at all except at two diametrically opposed points around the circumference of base plate 30' where it contacts the inner wall of the cone. Rather than being securely gripped, as in FIG. 6, the yarn is pinched at this point. The relatively small area of contact between the cone and base plate surface 32 greatly increases the likelihood of relative movement between cone 10 and base plate 30' as the winder starts and stops. Furthermore, since the yarn is gripped only at a very narrow point around the circumference of base plate 30', the likelihood of pinching the yarn in two is greatly increased.

Figure 8:
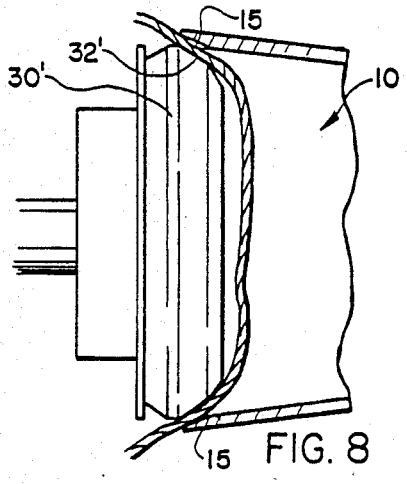
FIG. 8 is a fragmentary cross-sectional view of a textile package according to one embodiment of the present invention mounted on a base plate of the type shown in FIG. 7.

Referring now to FIG. 8, the advantage of the cone 10 according to the present invention is clearly shown. The yarn tail is formed in the usual manner, as illustrated in FIG. 4. When cone 10 is pressed onto base plate 30', the tapered surface 32' contacts the inner wall 12 in the usual manner. However, the presence of the grooves 15 provide a place within which the yarn can at least partially reside in such a manner as to be restrained against movement should relative movement between base plate 30' and cone 10 result. Furthermore, since the yarn is, in a sense, "buried" somewhat below the surface of inner wall 12 of cone 10, in one of the grooves 15, any such pinching action would have a tendency only to depress the yarn somewhat further into the groove 15 rather than cut or pinch it in two.

Figure 2:
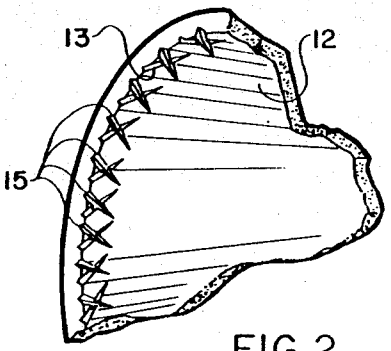
FIG. 2 is an enlarged, fragmentary perspective view of the grooves of the yarn package shown in FIG. 1.

While a single series of grooves in substantial axial alignment with cone 10 would suffice, a substantial advantage is seen in the criss-cross arrangement shown in FIGS. 1, 2 and 4, in that no matter what particular alignment the yarn may initially assume when cone 10 is pressed onto base plate 30', it will almost certainly be in at least approximate alignment with one of the nearby grooves 15. Since the cone 10 is twisted slightly as it is pressed onto base plate 30', the yarn will be moved into the nearest groove 15 before the winder starts. Therefore, the possibility of yarn breakage on the initial start-up is reduced substantially.

Figure 9:
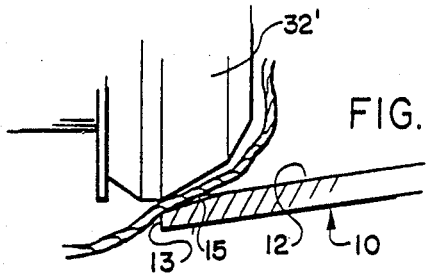
FIG. 9 is an enlarged, fragmentary view showing the area of contact between the textile package, yarn and base plate, as in FIG. 8.

The position assumed by the yarn with relation to cone 10, groove 15 and base plate 30' is most clearly shown in FIG. 9.

Figure 10:
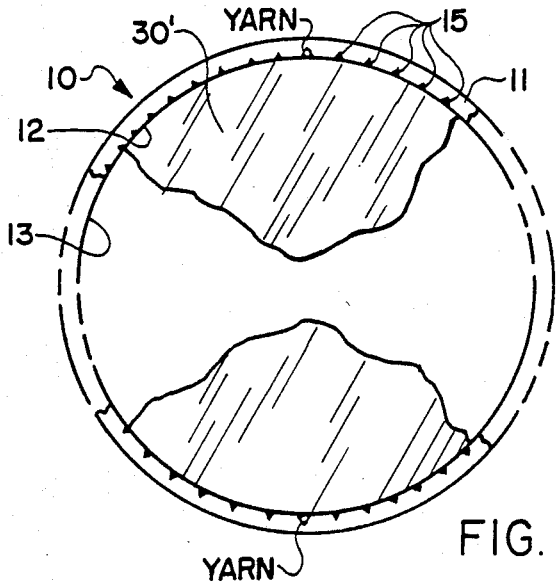
FIG. 10 is a fragmentary, vertical cross-sectional view perpendicular to the view shown in FIG. 8.

FIG. 10 graphically illustrates the protection offered to the yarn by the grooves 15 in cone 10. It is not essential that groove 15 be large enough so that the yarn completely resides within it. Rather, it is sufficient if a substantial percentage, on the order of greater than ½, of the yarn resides within groove 15. This is sufficient to retard movement and pinching of the yarn by base plate 30'.

Figure 11:
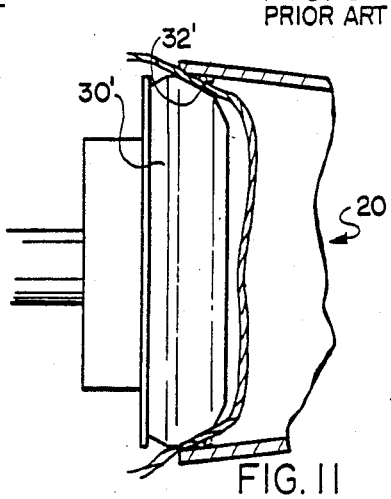
FIG. 11 is a fragmentary cross-sectional view of the embodiment of the invention having a ring of loose, non-woven fibrous material.
Figure 12:
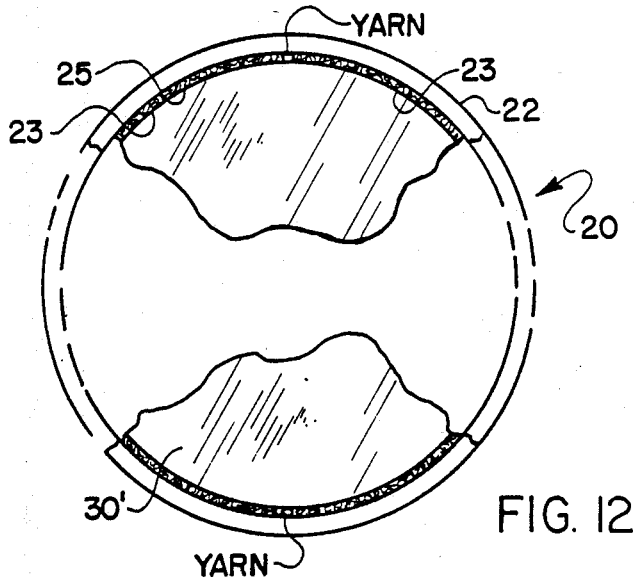
FIG. 12 is a fragmentary, vertical cross-sectional view perpendicular to the view shown in FIG. 11.

The same general results can be achieved by means of the construction shown in FIG. 3. As is shown in FIG. 11, the loose fibrous material 25 forms a "nest" within which the yarn resides. Tension on the yarn will cause the yarn to bury itself within the fibrous material 25 in such a way that the surrounding, upstanding fibers protect and cushion the yarn against direct pinching contact with base plate 30'. This principle is illustrated in FIG. 12 where, as is the case with FIG. 10, the yarn is protected by pinching base plate 30' by being surrounded by a protective structure which itself directly contacts base plate 30'.

The manner of forming grooves 13 in cone 10 is shown as illustrated in FIGS. 13 and 14. During manufacture, cones 10 are moved laterally along a conveyor 40 and, at a particular point are clamped by diametrically opposed and vertically offset clamping members 41 and 42. Clamping members 41 and 42 have, respectively, correspondingly tapered interior walls 43 and 44 which substantially conform to the frusto-conical shape of the cones 10. When the clamping members 41 and 42 are moved together, they embrace a particular cone 10 and prevent it from rotating. At this point, cone 10 is held firmly in axial alignment with a knurling machine 50, which includes a drive motor (not shown) within a drive motor housing 51, which rotates a knurling head 52. Positioned within knurling head 52 is a pair of knurling gears 53 and 54 having helical teeth thereon. Knurling gears 53 and 54 are mounted for planetary rotation in articulated, spaced-apart relation on a spacing bar 55 which itself is mounted for rotation on a shaft 58. Knurling head 52 is mounted for sliding in-and-out movement in coaxial alignment with cone 10. Knurling head 52 moves into contact with cone 10 and spacing bar 55 is rotated. The knurling gears 53 and 54 cut into the paper structure of cone 10 sufficient to form the grooves 15. The angle of the helical teeth on gears 53 and 54 are opposed so as to form the criss-cross pattern of grooves 15. By using only one or the other of gears 53 and 54, a single series of helical, parallel grooves would be cut into cone 10. After grooves 15 are cut, knurling head 52 is withdrawn, clamping members 41 and 42 are released, cone 10 is moved laterally out of position by conveyor 40 and a new cone 10 is moved into position for clamping and knurling.

Knurling head 52 is shown in enlarged form in FIG. 14.

A tubular yarn package which provides a means for protecting yarn against breakage, and a method of preventing breakage of yarn tails on tubular textile yarn packages is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. In a tubular textile yarn package of the type held by at least one end thereof in contact with a rotatably mounted plate, which plate fits into the one end of the package and traps across the end of and against an inner wall of the package a length of yarn to form a yarn tail, the improvement which comprises:

yarn protection means formed on the inner wall of the package proximate to the one end of the package for gripping the yarn at at least one point thereon in the area of contact between the package and the plate to prevent breakage of the yarn by relative movement between the package and the plate occasioned by starting or stopping the rotation of the package;

said yarn protection means comprising a substantially spirally extending groove formed in the inner wall of said package adjacent to the end of said package and adapted to receive a length of the yarn therein.

2. In a tubular textile yarn package according to claim 1, wherein said groove communicates with the end edge of the package.

3. In a frusto-conical tubular textile yarn package held in a cradle on opposite ends thereof by a rotatably mounted base plate inserted into the large end of and in contact with said package and a rotatably mounted nose plate inserted into the small end of said package, which base plate traps across the large end of the package and against the inner wall of the package a length of yarn to form a yarn tail, the improvement which comprises yarn protection means formed on the inner wall of the large end of said textile package for gripping the yarn at at least one point thereon at the point of contact between the package and the base plate to prevent breakage of the yarn by relative movement between the base plate and package during stopping and starting, said yarn protection means comprising a plurality of closely spaced-apart, substantially spirally extending grooves formed in the inner wall of said package adjacent to the large end of said package and adapted to receive a length of the yarn therein.

4. In a tubular textile yarn package according to claim 3, wherein said groove communicates with the end edge of the package.

5. In a tubular package according to claims 1 or 3, wherein said grooves are formed by knurling.

6. In a package according to claims 1 and 3, wherein said grooves extend completely around the inner wall of said package.

7. In a tubular yarn package according to claims 1 or 3, wherein said cone is constructed of compressed paper.

8. In a tubular yarn package according to claims 1 or 3, wherein said grooves comprise a multiplicity of closely spaced-apart serrations.

9. In a textile yarn package according to claims 1 or 3, wherein said grooves are formed in said textile package in a criss-cross configuration.

* * * * *